US005307648A

United States Patent [19]

Forkert et al.

[11] Patent Number: 5,307,648

[45] Date of Patent: May 3, 1994

[54] CONTROL ARRANGEMENT COMPRISING SYNCHRONEOUS SIGNAL FOR KNITTING MACHINE GUIDE BARS

[75] Inventors: Jurgen Forkert, Rodgau; Friedrich Gille, Obertshausen, both of Fed. Rep. of Germany

[73] Assignee: Karl Mayer Textilmaschinenfabrik GmbH, Obertshausen, Fed. Rep. of Germany

[21] Appl. No.: 60,310

[22] Filed: May 10, 1993

[30] Foreign Application Priority Data

May 13, 1992 [DE] Fed. Rep. of Germany ..... 4215798

[51] Int. Cl.[5] ..... D04B 23/00; G06F 15/46

[52] U.S. Cl. ..... 66/207; 66/203; 364/470; 318/41

[58] Field of Search ..... 66/203, 204, 165, 157, 66/207; 364/470, 167.01; 318/41, 51

[56] References Cited

U.S. PATENT DOCUMENTS 4,135,115 1/1979 Seeger et al. ..... 318/41 X
4,364,002 12/1982 Suzuki et al. ..... 364/470 X

FOREIGN PATENT DOCUMENTS 2349931 9/1974 Fed. Rep. of Germany ..... 66/204
2733069 1/1978 Fed. Rep. of Germany ..... 66/207
4103618 8/1992 Fed. Rep. of Germany ..... 66/207

*Primary Examiner*—Clifford D. Crowder
*Assistant Examiner*—John J. Calvert
*Attorney, Agent, or Firm*—Omri M. Behr; Matthew J. McDonald

[57] ABSTRACT

A warp knitting machine comprises at least one guide bar and one main shaft. The angular position of the main shaft is determined by an absolute transmitter, while the position of the guide bar is determined by an absolute transmitter. Each transmitter can provide a different signal value for each angular position of the main shaft and for each guide bar position. A continuous displacement function is developed for the guide bar. This function relates each measured angular position of the main shaft with a position target value for the guide bar. A position control circuit controls a setting motor that displaces the guide bar. In this way, the danger of collision between elements of the guide bars and other working parts of the machine are practically totally avoided.

15 Claims, 1 Drawing Sheet

Fig.1
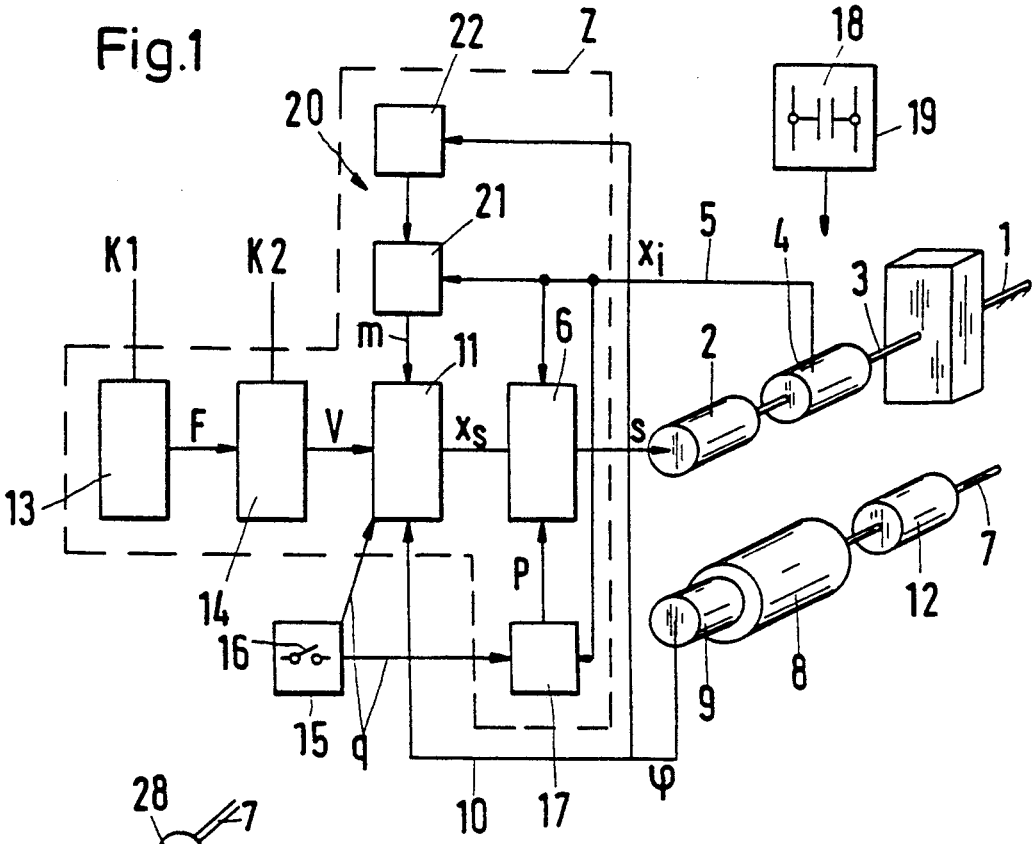
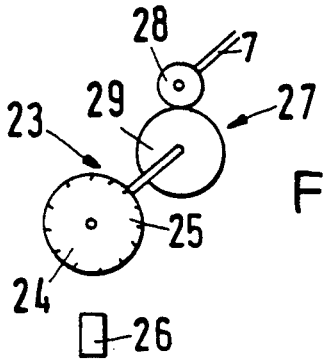
Fig.2
Fig.3
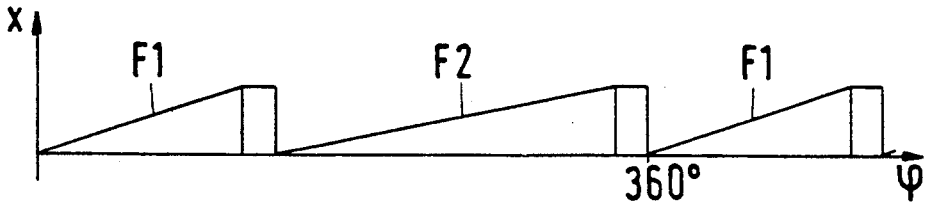
Fig.4
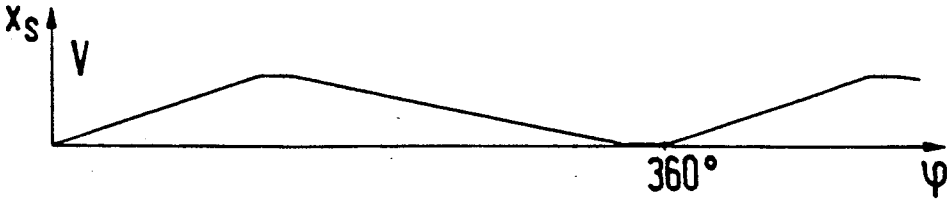

CONTROL ARRANGEMENT COMPRISING SYNCHRONEOUS SIGNAL FOR KNITTING MACHINE GUIDE BARS

BACKGROUND OF THE INVENTION

1. Field Of The Invention

The present invention is directed to a warp knitting machine including: (a) at least one guide bar which is axially displaceable by an electrical setting motor having a position signal transmitter, (b) a main shaft which is continually rotatable by an electrical main motor and which is provided with a synchronization signal transmitter, and (c) a schedule transmitter which outputs a position target value to a position control circuit controlling the setting motor, according to at least one displacement schedule in dependence upon the synchronization signal.

2. Description Of Related Art

Such a warp knitting machine is known from German DE OS 22 57 224. The displacement sequence to be carried out are read from a schedule carrier, for example, a hole punched or magnetic tape. A synchronizing signal transmitter generates a signal for particular angular positions of the main shaft based on which, the last read displacement step is then executed with the assistance of a position control circuit. By using another schedule carrier, the pattern of the warp knitted fabric can be changed by altering the guide displacement movement. The progress of the displacement movement is not completely controllable. It depends substantially upon the design of the control circuit. A disadvantage of these uncontrolled movements is that collisions can occur between the guides and other working parts, for example, when swinging through the needle bed or by underlaps with knock-over sinkers.

Thus there is a need for a warp knitting machine of the aforementioned type in which the danger of collision is substantially avoided.

SUMMARY OF THE INVENTION

In accordance with the illustrative embodiments demonstrating features and advantages of the present invention, there is provided a warp knitting machine having at least one axially reciprocatable guide bar. An electric setting motor is coupled to this guide bar for reciprocating it. A position signal transmitter coupled to the guide bar can provide bar position signals signifying varying positions of said guide bar. This position signal transmitter is an absolute transmitter for uniquely assigning the bar position signals based on different positions of said guide bar. A main drive section has a main shaft and an electrical main motor for continually rotating the main shaft. A synchronizing signal transmitter coupled to he main drive section can provide synchronizing signals signifying varying angular positions of the main shaft. This synchronizing signal transmitter is an absolute rotational angle transmitter for uniquely assigning the synchronizing signals based on different angular positions of the main shaft. A schedule transmitter coupled to the synchronizing signal transmitter can generate in response to the synchronizing signals, position target values following at least one predetermined displacement schedule defined by a continual displacement function. This schedule transmitter can definitively and singularly assign the position target values from each of the synchronizing signals in accordance with the continual displacement function Also included is a position controller coupled to the setting motor and the schedule transmitter. The position controller is responsive to the position target values and can control the setting motor.

In a preferred embodiment of the present invention, in the synchronization signal transmitter is an absolute rotation angle setting transmitter such as a shaft encoder for generating a different signal value for each rotational angle position of the main shaft. Preferably, the position signal transmitter is an absolute generator, which provides a different signal value for each position of the guide bar. Moreover, the displacement scheme for the guide bar is formed preferably by a continuous displacement function relating a particular position target value for the guide bar with every rotational angle signal value for the main shaft.

In this embodiment, the guide bar is continuously guided by a position target value, which corresponds exactly to the rotational angle position of the main shaft (and thus to an exact predetermined constellation of the other working components of the machine). The guides can thus move in a collision-free manner. Since the rotational angle position of the main shaft as well as the position of the guide bar is measured by the absolute transmitters, the desired relative orientation is always maintained and there is no danger that a collision will occur because of a faulty displacement. Nevertheless, the patterning can be readily altered in that the schedule transmitter can be fitted with a different displacement function.

Preferably, the signal values of the absolute transmitters are code values, for example, shaft encoders supplying a Gray code. By the use of a binary code, very fine divisions of angle or path may be obtained, so that a quasi-continuous read out is possible.

One preferred embodiment has an intermediate storage means, which stores the measured guide bar position for the at-rest position of the main shaft. Also included are means which, when the machine is thereafter put into motion, generates a position correction for the guide bar from the stored measurement. Sometimes, the guide bar is disturbed from its resting position existing at the time the main shaft stopped (for example, because of thread tension). Compensation is provided for this disturbance after the machine has been put into motion. Specifically, the displacement movement of the guide bar is synchronized with the rotation of the main shaft. Thus, stopping of the machine is either entirely or substantially unnoticed in the final fabric.

A further embodiment contemplates means which, when the machine is next put into operation, causes a position correction of the guide bar, influenced by the position target value generated by the instantaneous angular measurement for the main shaft. This approach permits the avoidance of errors which occur when the guide bar does not come to rest at the same moment as the main shaft.

Preferably, the main shaft has a brake which operates in the event of current failure to quickly stop the main shaft. After such failure, current is still provided to the setting motor and its control means, via an intermediate condenser circuit.

By using an intermediate condenser circuit during the braking movement of the main shaft, the setting motor is still controlled normally, so that erroneous settings of the guide bar are avoided or kept to an absolute minimum.

Furthermore, it is advantageous for the displacement function to change between at least two successive knitting cycles. To this end, the measurements of main shaft angle can distinguish between two successive revolutions. In this manner, one can provide a first displacement function to uneven rotations and a second displacement function to the even numbered rotations. Since the main shaft cycles are differentiable, the desired provision of a displacement function changing from one knitting cycle to the next is possible.

In a special embodiment, the position transducer has a rotating transmitting element that, over its circumference, generates different rotational angle signal values and is coupled to the main shaft by an integral reduction means. This reduction means yields the desired coordination of the displacement function to the knitting cycle.

In a preferred embodiment, the schedule transmitter comprises a computer which creates the displacement function for the overlap and underlap displacements by assembling stored transition curve. These transition curves are suitably so designed that during the displacement movement, only the smallest accelerations or decelerations occur, with the result that high operating speeds may be obtained. Since a plurality of transition curves can be stored and assembled in various combinations, there is a wide choice as to what is the optimal modelling of the displacement movement to the particular pattern in question. Since the transition curves can be utilized in different combinations, one is able to operate with a rather small number of such curves.

Preferably, the position control circuit has a collision warning means, which can utilize the measured guide position, calculate the future changes in position, compare these with forbidden areas, and where these coincide, prohibit the displacement movement. Such a survey gives additional assurance against collisions.

BRIEF DESCRIPTION OF THE DRAWINGS

The invention can be illustrated by the following drawings, which show:

FIG. 1 is a block switching diagram of the principle segment of the warp knitting machine of the present invention.

FIG. 2 is an embodiment of the absolute transmitter for the rotational angle setting of the main shaft.

FIG. 3 shows the sequence of transition curves.

FIG. 4 is the displacement function generated by the curves of FIG. 3.

DETAILED DESCRIPTION OF THE PREFERRED EMBODIMENTS

Referring to FIG. 1, the illustrated machine comprises a guide bar 1, which is mounted to axially reciprocate. Bar 1 is connected via connecting rod 3 to setting motor 2, which is in the form of an electrical linear motor. An absolute position transmitter 4 in the form of a transducer encoder is coupled to the junction between motor 2 and rod 3. Transmitter 4 generates an actual position value $X_i$ and is connected via line 5 to position controller 6.

The main shaft 7 of the warp knitting machine is driven by electric motor 8. The main shaft 7 is further provided with a braking means 12, described in further detail hereinafter. An absolute rotational angle setting transmitter 9 reports the actual angular position of shaft 7 over line 10. This signal on line 10 (referred to as a synchronizing signal) is applied to an output arrangement 11. Arrangement 11, in dependence upon the signal on line 10, transmits a position target value $X_s$ to the position controller 6.

Position controller 6 produces an output S as a function of the signals $X_i$ and $X_s$ (e.g. the difference between them). In dependence upon this control deviation, signal S regulates the setting motor 2.

A position target value X. is determined by the characteristic data K1 and K2. A plurality of prototype transition curves F may be stored in storage means 13, which may be a digital memory. Curves F may be a plurality of data pairs (or tables) each containing a displacement value paired with a main shaft position value. The curves F may be assembled in sequence, (and optionally rescaled and/or inverted) to compose a schedule for the overlap and underlap displacements. The appropriate transition curve for the desired pattern are defined by the characteristic value K1.

A computer 14 is instructed to use a specific calculation formula by characteristic data K2, which thereby defines the processing of prototype transition curves F. The said calculation formula comprises among other things, commands to set the sign (inversion or non-inversion) and integral multiplication (scale) for the respective transition curves. From these assembled transition curves, computer 14 generates a displacement function V. Using this function, (which uses as an input variable the synchronizing signal on line 10) output arrangement 11 reads off the appropriate reference value $X_s$.

In this manner, there results a clear coordination between the angular measurement of the main shaft 7 on line 10 and the appropriate position of guide bar 1. Guide bar 1 is so controlled by the position controller 6 that it can run through the knitting cycle with greater assurance of collision avoidance.

Blocks 6 and 11 can be programmed with interrupt handlers that respond to increments in signals on lines 5 and 10. When signal $X_i$ changes, signal S is adjusted 10 based on the feedback function in arrangement 6 (e.g., a linear or integral function of $(X_i - X_s)$). When the signal on line 10 changes, signal $X_s$ is adjusted (e.g. by a look-up table formed in accordance with function V).

Nevertheless, when the machine is switched off, displacement errors can occur because the main shaft and the guide bar have different run-down times or because other forces such as thread tension come into play during the resting rest condition of the guide bar. In order to ensure that these displacement errors do not lead to collisions, the following steps are to be undertaken:

a) A block 15 contains a means which, upon the activation of the machine by switch 16, transmits a signal "q" to position controller 11. This ensures that ultimately the position correction for the guide bar 1 depends upon the appropriate position target value $X_s$ corresponding to the appropriate synchronizing signal on line 10. When thereafter the main motor runs rapidly, this takes place synchronously with the guide bar motion.

b) The position signal value $X_i$ is transmitted to and stored in an intermediate storage means 17 during the resting position of the main shaft 7. When the machine is returned to operation, this previous signal value $X_i$ is transmitted as a correction signal "p" to the position controller 6. (That portion of the storage means 17 acting to transmit said signal "p" being referred to as a transient means.) Controller 6 thereupon returns the guide bar 1 into the appropriate initial position before the main shaft runs up to speed. This correction process is particularly useful in the case where the guide bar was controlled by the main shaft until it came to rest.

c) In order to assure this guidance and thereby keep the displacement errors to a minimum, there is provided a braking means 12 which operates in the case of power failure so that the main shaft comes to rest within a few seconds. During this time, the setting motor 2 and the entire control arrangement is provided with current from an uninterrupted power supply. This power supply can store electrical energy in a capacitor 18 of an intermediate condenser circuit 19, which temporarily runs an inverter (not shown) when line current fails. Such a condenser 18 thereby keeps guide bar 1 under the control of the main shaft 7 until coming to rest.

Furthermore, the position control circuit 11 (together with circuit 6 being also referred to as a position control means) is provided with collision anticipation means 20 to guard against collisions. Means 20 comprises a computer 21, which from the position signal values $X_i$ and their rate of change, can calculate future positions. Forbidden zones are stored in storage means 22. While some forbidden zones are defined without regard to the phase of the knitting cycle, other embodiments may establish conditional zones forbidden at specified phases of the knitting cycle. The guide bars are forbidden from entering these zones either permanently or during particular times in the work cycle. The computer 21 compares the predicted future positions of the guide bar 1 with these forbidden zones. When correlation occurs, computer 21 prohibits a further displacement by means of a blocking signal "m."

In actual practice, blocks 6, 11, 14, 21, as well as storage areas 13, 17 and 22, need not be separate items. In fact, it is preferred that they should be integrated into the central processing unit (CPU Z) and commercialized as a process computer.

FIG. 2 illustrates an absolute rotation angle setting transmitter 23, which has a rotating transmitting element 24. Element 24 has on its circumference a very finely segmented binary code 25 which can be interrogated by reading element 26. For example, the circumference may be divided up into 4,000 separate increments. Each increment may be identified by indicia encoded with Gray or other code residing in a number of optically or electrically readable bands.

The transmitting element 24 is driven by the main shaft 7 via a reduction drive 27. The circumferences of drive wheels 28 and 29 stand in an integral relationship to each other, as illustrated here, a 1:2 relationship. Transmitting element 24 thus generates different rotational angle signal values to distinguish two successive revolutions of the main shaft. It is however possible to operate with a reduction relationship of 1:4; 1:6 and so on.

FIG. 3 illustrates individual transition curves F1 for the guide overlap and F2 for the guide underlap, as they are stored in storage means 13. From these prototype values, computer 14 may calculate the displacement function V, which is illustrated in FIG. 4. In this simple case, the calculation operation involves inverting transition curve F2 and arranging it to follow transition curve F1. The transition curves are thus set for the desired guide displacement about a single needle space. For a displacement over a plurality of needle spaces, one may utilize the same transition curves but multiplied in the computer by various integers.

In the illustrated examples, the transition curves are shown as straight lines. In practice however, there are utilized special curves which approximate sinusoidal, parabolic, or hyperbolic curves, or are assembled from a variety of curve segments. It is the aim to minimize accelerations or decelerations.

A displacement function V can also take care of other displacement errors such as occur (a) in the use of an articulating push rod to the guide bar drive, or (b) with needle deflection due to the tension of the thread utilized in the system.

We claim:

1. A warp knitting machine comprising:

at least one guide bar, said guide bar being axially reciprocatable;

an electric setting motor coupled to said guide bar for reciprocating it;

a position signal transmitter coupled to said guide bar for providing bar position signals signifying varying positions of said guide bar, said position signal transmitter being an absolute transmitter for uniquely assigning said bar position signals based on different positions of said guide bar;

a main means having a main shaft and an electrical main motor for continually rotating said main shaft;

a synchronizing signal transmitter coupled to said main means for providing synchronizing signals signifying varying angular positions of said main shaft, said synchronizing signal transmitter being an absolute rotational angle transmitter for uniquely assigning said synchronizing signals based on different angular positions of said main shaft;

a schedule transmitter coupled to said synchronizing signal transmitter for generating in response to said synchronizing signals, position target values following at least one predetermined displacement schedule defined by a continual displacement function, said schedule transmitter being operable to definitively and singularly assign said position target values from each of the synchronizing signals in accordance with said continual displacement function; and a position control means coupled to said setting motor and said schedule transmitter and being responsive to said position target values for controlling said setting motor.

2. A warp knitting machine in accordance with claim 1 wherein said synchronizing signals and said bar position signals are encoded.

3. A warp knitting machine in accordance with claim 1 comprising:

an intermediate storage means for storing a transient value corresponding to that value exhibited by the bar position signal upon a halting of the main shaft; and transient means coupled to said position control means for transmitting thereto a position correction signal upon a start-up of the machine next following said halting of the main shaft, said position correction signal being based upon the transient value.

4. A warp knitting machine in accordance with claim 3 comprising means for providing to said position control means, in response to repowering of said main motor of said warp knitting machine, a position correction signal, said position correction signal being based upon the position target value that is derived from the synchronizing signal prevailing upon repowering.

5. A warp knitting machine in accordance with claim 1 comprising means for providing to said position control means, in response to repowering of said main motor of said warp knitting machine, a position correction signal, said position correction signal being based upon the position target value that is derived from the synchronizing signal prevailing upon repowering.

6. A warp knitting machine in accordance with claim 5 comprising:

a braking means coupled to said main shaft for braking it in response to current interruption at said main motor; and an intermediate condenser circuit for at least temporarily providing current to said setting motor and said position control means after current interruption at said main motor.

7. A warp knitting machine in accordance with claim 1 comprising:

a braking means coupled to said main shaft for braking it in response to current interruption at said main motor; and an intermediate condenser circuit for at least temporarily providing current to said setting motor and said position control means after current interruption at said main motor.

8. A warp knitting machine in accordance with claim 3 comprising:

a braking means coupled to said main shaft for braking it in response to current interruption at said main motor; and an intermediate condenser circuit for at least temporarily providing current to said setting motor and said position control means after current interruption at said main motor.

9. A warp knitting machine in accordance with claim 4 comprising:

a braking means coupled to said main shaft for braking it in response to current interruption at said main motor; and an intermediate condenser circuit for at least temporarily providing current to said setting motor and said position control means after current interruption at said main motor.

10. A warp knitting machine in accordance with claim 7 wherein said schedule transmitter is operable to cause said displacement function to vary between at least two successive knitting cycles, said synchronizing signal transmitter imbuing the synchronizing signals with information for distinguishing between two successive revolutions of said main shaft.

11. A warp knitting machine in accordance with claim 10 wherein said synchronizing signal transmitter comprises:

a rotating transmitting element having a circumference carrying a plurality of differentiable indicia signifying differentiable rotation angle signal values; and integral reduction means coupled between said main shaft and said rotating transmitting element for reducing the speed of the latter.

12. A warp knitting machine in accordance with claim 1 wherein said schedule transmitter is operable to cause said displacement function to vary between at least two successive knitting cycles, said synchronizing signal transmitter imbuing the synchronizing signals with information for distinguishing between two successive revolutions of said main shaft.

13. A warp knitting machine in accordance with claim 12 wherein said synchronizing signal transmitter comprises:

a rotating transmitting element having a circumference carrying a plurality of differentiable indicia signifying differentiable rotation angle signal values; and integral reduction means coupled between said main shaft and said rotating transmitting element for reducing the speed of the latter.

14. A warp knitting machine in accordance with claim 12 wherein the schedule transmitter comprises:

a computer having means for storing data pairs corresponding to transition curves, said computer being operable to assemble data of said transition curves to compose said displacement function into an overlap displacement and an underlap displacement.

15. A warp knitting machine in accordance with claim 1 wherein said position control means comprises:

collision anticipation means coupled to said position signal transmitter and responsive to current values of and variations in said bar position signals for predicting future positions of said guide bar and prohibiting displacement movement thereto upon detecting coincidence between said future positions and predetermined forbidden zones.

* * * * *